US006710310B2

(12) United States Patent
Hantz

(10) Patent No.: US 6,710,310 B2
(45) Date of Patent: Mar. 23, 2004

(54) HEATING ELEMENT WITH INTEGRATED HEAT SAFETY DEVICE

(75) Inventor: Pascal Hantz, Archettes (FR)

(73) Assignee: SEB S.A., Ecully (FR)

( * ) Notice: Subject to any disclaimer, the term of this patent is extended or adjusted under 35 U.S.C. 154(b) by 63 days.

(21) Appl. No.: 10/181,152

(22) PCT Filed: Jan. 10, 2001

(86) PCT No.: PCT/FR01/00065

§ 371 (c)(1),
(2), (4) Date: Jul. 15, 2002

(87) PCT Pub. No.: WO01/52601

PCT Pub. Date: Jul. 19, 2001

(65) Prior Publication Data

US 2003/0010772 A1 Jan. 16, 2003

(30) Foreign Application Priority Data

Jan. 13, 2000 (FR) ..... 00 00415

(51) Int. Cl.[7] ..... H05B 1/02

(52) U.S. Cl. ..... 219/494; 219/517; 219/541; 219/544; 219/523; 392/455; 392/497; 337/404

(58) Field of Search ..... 219/517, 538–541, 219/494, 505, 491, 544, 548, 512, 523; 392/497–501, 451, 455; 337/393, 403–410, 416

(56) References Cited

U.S. PATENT DOCUMENTS 4,001,754 A 1/1977 Plasko
4,384,267 A * 5/1983 Aoki ..... 337/407
4,390,776 A * 6/1983 Yane et al. ..... 219/523
5,020,128 A 5/1991 Bleckmann
6,392,208 B1 * 5/2002 Arx ..... 219/544

FOREIGN PATENT DOCUMENTS

| | | |
|---|---|---|
| DE | 34 33 688 A1 | 3/1986 |
| DE | 42 43 894 A1 | 7/1993 |
| EP | 0 651 589 A2 | 5/1995 |
| FR | 2 579 854 | 10/1986 |
| JP | 6-267641 | 9/1994 |

* cited by examiner

*Primary Examiner*—Mark Paschall
(74) *Attorney, Agent, or Firm*—Browdy and Neimark

(57) ABSTRACT

The invention relates to armoured heating elements. The invention specifically relates to a heating device (1) consisting of a tubular envelope, wherein a heating element (4) surrounded by insulation (3) is arranged, said heating element (4) is connected to an electric supply circuit by connecting (14) rods and pins (10,12) and said tubular envelope (2) is provided with two cylindrical sealing beads (16) arranged in the ends thereof, whereby at least one of the beads known as a specific bead (16) is in direct contact with the insulation (3) surrounding the heating element (4); The invention is characterized in that the specific bead (16) comprises an axially transversal recess (18), wherein a thermal fuse (20) is inserted and electrically and serially mounted with said heating element (4).

11 Claims, 2 Drawing Sheets

HEATING ELEMENT WITH INTEGRATED HEAT SAFETY DEVICE

The present invention concerns an electric heating element of the enclosed type and more particularly to the integration of a heat safety device into this element.

BACKGROUND OF THE INVENTION

In the field of heating elements of the enclosed type, i.e. having a tubular envelope at the interior of which is placed a heating element embedded in an insulator, there is known, from the document DE 34 33 688, a tubular heating body containing a spiral resistive heating wire enclosed in a powder of insulating material such as magnesia. A heat protection element is connected in series with the heating spiral at the interior of the tube. This protection element is a fusible bead that, in the case of overheating, frees a compression spring permitting definitive interruption of the circuit for supplying the heating spiral.

This heating element thus corresponds to a fuse placed in series with the heating element in the tubular envelope, requiring an intermediate connection. Furthermore, confinement of the fuse within the heating element is a source of possible re-ionization of gas around the fuse when this latter is vaporized by overheating of the device, being able to lead, within the insulating material, to a reclosing of the electric supply circuit that has just been opened. This possibility of dysfunctioning of the safety device must be avoided as much as possible because its consequences can be serious.

The document JP 6267641 provides an element of response to the problems mentioned above. The heating element presented in this document is shown in FIG. 1. Thus, a heating element 70 has a spiral resistance 72 contained in a first tube 71 within an insulating powder 73. The spiral resistance 72 is held by two connection pins 78*a* and 78*b* through two sealing beads 74*a* and 74*b* arranged in the extremities of this first tube 71. A heat protection fuse 77 is housed between bead 74*b* and a third end bead 76*b* arranged in a second tube 75 containing the first tube. This fuse is connected to pin 78*b* as well as a pin 78*c* connected to an electric supply circuit. At its opposite extremity, a fourth bead 76*a,* traversed by the pin 78*a* assures sealing of the second tube.

In this device, the fuse is certainly not housed within the heating element, but is nonetheless confined between two sealing beads, which does not eliminate completely the risks of re-ionization of the surrounding gas after triggering, bead 76*b* constituting particularly a thermal brake. In addition, the insertion of the fuse requires a specific connection. Overall, four beads and two tubes are thus necessary to obtain a heating element having a heat fuse at one of its extremities, which increases in a notable manner the selling price of the assembly.

SUMMARY OF THE INVENTION

The object of the present invention is to overcome the drawbacks of the prior art by presenting an electric heating device constituted by a tubular envelope, at the interior of which is housed a heating element enclosed by an insulator, said heating element being connected to an electric supply circuit by connection rods and pins, said tubular envelope being provided with two cylindrical sealing beads arranged at its extremities, at least one of these beads, called a specific bead, being in direct contact with the insulator enclosing the heating element, characterized in that the specific bead is axially traversed by an opening into which is inserted a heat fuse connected electrically in series with the heating element.

By this arrangement, the number of constituent elements is reduced since one bead assures at the same time a tight seal of the insulator enclosing the heating element, but also maintenance and protection of the housing of the fuse. Thus, without a supplemental element other than the tubular envelope and the two sealing beads, it is permitted to constitute, not only the heating assembly, but equally the addition of a heat fuse. This arrangement avoids, moreover, wiring between the heating element and the fuse within the device, just like the specific means for maintenance and protection of the fuse in the product.

Advantageously, the heating element is in spiral form and mounted under tension in the tubular envelope.

This configuration permits notably the sealing beads, connected to the ends of the heating element, to be maintained by being supported on the extremities of the tubular envelope without a specific part.

Advantageously, the opening has a narrowing at the level of the extremity connected with the interior of the tube, against which the fuse is positioned.

Together with the traction effect exerted by the spiral element, the narrowing formed in the opening permits correct and systematic positioning of the fuse in the opening, without any particular mechanical part. This equally permits assurance of the sealing of the tube with respect to the insulator enclosing the heating element.

According to a preferred embodiment of the invention, the heat fuse has a housing within which is housed a compression spring exerting a pressure between, on the one hand, a heat block situated at the outer extremity of the housing and in contact with an external connection pin and on the other hand a first central sliding disc pushed while resting against an internal connection rod, and this against a restoring force exerted by an opening spring coaxial with the connecting rod.

This association permits, when the heat block is vaporized, opening of the electric supply circuit of the heating element, with the aid of the two springs, compression and opening, releasing while carrying away the first contact disc, into the space left free by the block, thus out of contact with the connecting rod.

Advantageously, the connecting rod is surrounded, within the heat fuse, by an insulator, equally permitting centering and/or maintaining the connecting rod at a distance from the housing of the fuse.

Advantageously, the heat block is situated at the extremity of the fuse housing situated outside of the tubular envelope.

This permits a better controlled reactivity of the protection constituted by the heat fuse, by slightly spacing it from the heating element.

Moreover, direct contact between the block and one of the external connection pins avoids re-ionization of the gas produced during melting of the block, notably by permitting a rapid flow of the heat generated.

In addition, this thermal escape, moreover relative, equally guarantees a better aging of the fuse, preventing its untimely triggering at a temperature lower than that for which it has been calibrated.

BRIEF DESCRIPTION OF THE DRAWINGS

The present invention will be better understood with the aid of the description that will follow, in reference to the attached figures, among which.

DETAILED DESCRIPTION OF THE DRAWINGS

Figure 1:
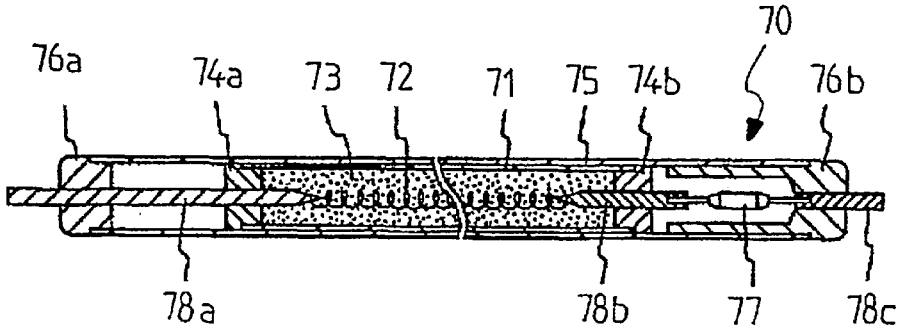
FIG. 1 represents a state of the art previously described.
Figure 2:
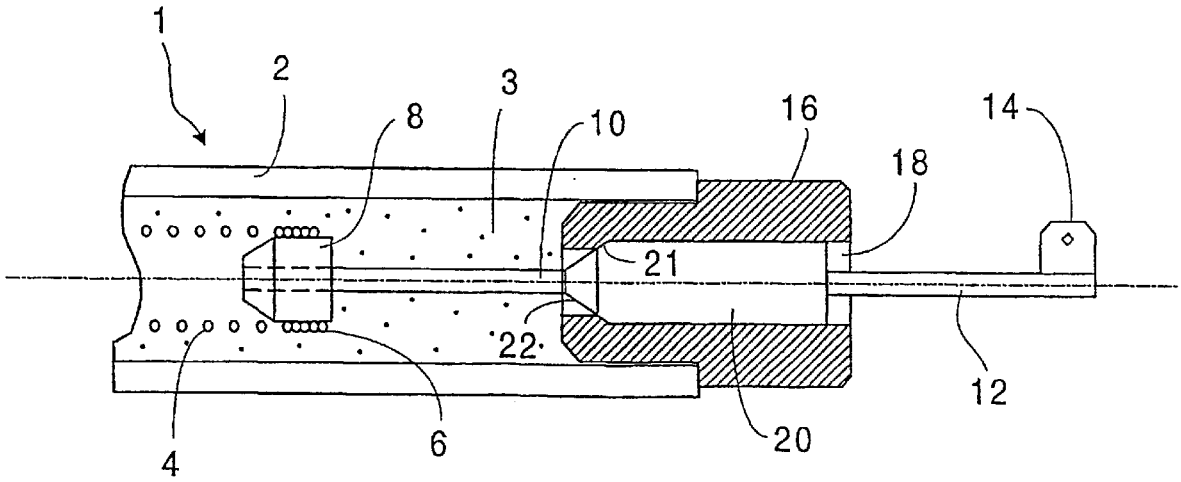
FIG. 2 is a cross-sectional view of the heating device at the level of the extremity of the tubular envelope having the heat fuse.

According to the invention, a heating device 1 is presented in FIG. 2 in the form of that which is currently called an enclosed resistance. This device comprises a tubular envelope 2 at the interior of which is housed a spiral heating element 4 enclosed by insulator 3 such as magnesia. Sealing beads for this insulator are arranged at each extremity of tubular envelope 2. At least one of these beads, called a specific bead as will be described in detail below, is in direct contact with insulator 3 enclosing spiral heating element 4, as is completely visible in FIG. 2. Preferably, the two sealing beads are in direct contact with said insulator.

Extremities 6 of heating element 4 are arranged, for example by soldering, each around a cylindrical connection or a terminal terminal spade lug 8 serving to connect the heating element to the exterior electric supply circuit. This cylindrical connection is thus extended by an electrical connection rod 10. At one of the extremities (not shown) of tubular envelope 2, electrical connection rod 10 passes through one of the sealing beads in order to establish electrical contact with the exterior supply circuit.

At the other extremity of the tubular envelope, the second sealing bead, called specific bead 16 is cylindrical and has an opening 18 axially traversing it. This opening is intended to receive a heat fuse 20. Preferably, the fuse will be mounted in the opening with a minimum of play.

Moreover, the opening has a narrowed zone at its internal part, i.e. situated at the side of the heating element, in the form for example of a cone 21. This cone cooperates with heat fuse 20 equally having a conical part 22 in order to prevent this latter from sliding towards the heating element.

Moreover, the spiral heating element is mounted under tension in the tubular envelope, so that the fuse undergoes a pulling force that tends to maintain it against conical part 22 of the opening, assuring, at the same time a sealing of the heating element, but also maintenance of the fuse, and jointly maintenance of bead 16 on the tubular envelope.

Heat fuse 20 is mounted in series with heating element 4 by the intermediary of connection rod 10. It is connected to the exterior electrical supply circuit by the intermediary of a pin 12 carrying a connector 14. This fuse thus provides the connection between the exterior electrical circuit and the interior of the tubular envelope.

With respect to tubular envelope 2, fuse 20 can be housed either partially at the interior of said envelope, or completely at the interior or completely at the exterior of said envelope, depending on the desired heat reaction characteristics for the protection device.

This fuse permits in effect cutting the electrical supply of the heating element in case of malfunctioning of the regulator element of the appliance, provoking an overheating of the resistance.

Calibration of the fuse, as well as its position in tubular envelope 2 are adapted to the temperature obtained at the level of the bead during an overheating, a lower temperature than within the heating element.

Figure 3A:
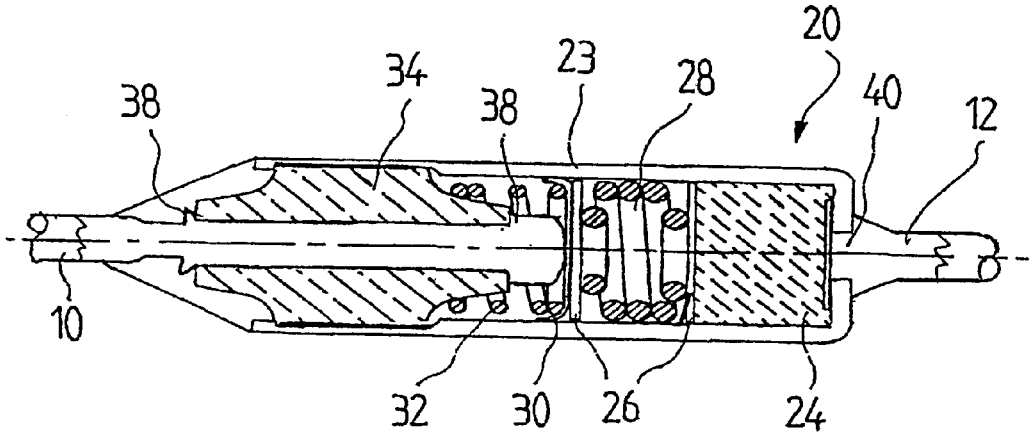
FIG. 3 is a detail view of the heat fuse in an untriggered operating state.
FIG. 3*b* is a detail view identical to the view 3*a,* but after triggering of rupture of said fuse.
Figure 3B:
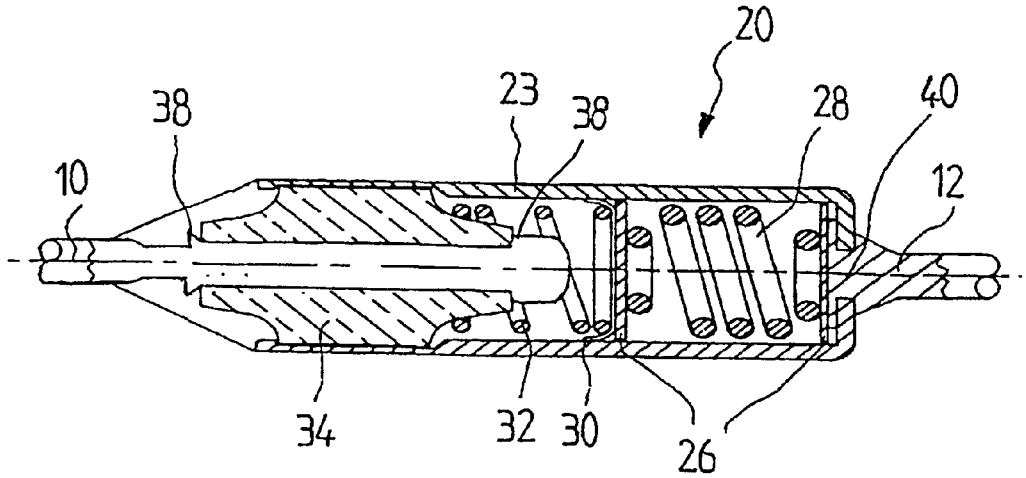

Heat fuse 20 is shown in detail in FIGS. 3*a* and 3*b* which illustrate its state respectively before and after triggering, i.e. respectively in the passing state of operation and in the cut state.

Thus, FIG. 3*a,* heat fuse 20 has a housing 23 at the interior of which is housed a heat block 24 having the particularity of vaporizing when it is subjected to a given temperature, corresponding, in our case, to an overheating of the heating element.

This block is arranged at the external extremity, i.e. furthest from the heating element, so as to not present an overly great reactivity which could lead it to vaporize while the heating element is not in an overheated state.

In order to interrupt the electrical supply circuit of the heating element, the fuse has a first compression spring 28 mounted between two discs 26. One of these discs is in contact with block 24, while the other assures the connection between this first spring 28 and a third disc 30 arranged against the restoring force of a second spring 32. Disc 30 is in contact with connection rod 10 immobilized in housing 23 by an insulator 34, with the aid particularly of recesses 38 on the connection rod.

In the untriggered state, spring 28 constrains internal disc 26 and contact disc 30 against the end of connection rod 10 assuring, by the heat block continuity of the electrical supply circuit.

By this fact, disc 30 is present in the form of a star contact in order to assure a good electrical contact. Other forms are equally possible without departing from the framework of the present invention.

Moreover, housing 23 has an opening 40 at the extremity where the heat block is housed, at the level of the connection with pin 12, permitting a direct contact between block 24 and pin 12. In addition, at the level of this connection the housing is exposed to the outside air by cavity 18.

Thus, when the heat block vaporizes, the heat generated can primarily and rapidly be dissipated, at the same time by exchange with the ambient air, due to cavity 18, but equally by conduction in pin 12. The risks of ionization are then very low, which provides a high reliability for the device.

The volatilization of the block leads to the release of the two springs 28 and 32 arriving at a mechanical equilibrium where particularly disc 30 is no longer in contact with connection rod 10. The electric supply circuit for the heating element is then interrupted.

Utilization of a conventional heat fuse in place of the usual connection terminal for the heating element, by integrating the thermal protection into the resistance permits in addition a direct temperature capture while eliminating a diffuser, while causing the thermal inertia to be more rapid and more reliable. The heating element is thus self-regulated.

In addition, by the present invention, the fuse is positioned in a single operation during attachment of the sealing bead. It is thus no longer a connected piece that requires additional steps for its integration within the heating device. The assembly time and the costs are thus reduced.

What is claimed is:

1. An electric heating device (1) constituted by a tubular envelope (2), at the interior of which is housed a heating element (4) enclosed by an insulator (3), said heating element (4) being connected to an electric supply circuit by rods and pins (10, 12) for connection (14), said tubular envelope (2) being provided with two cylindrical sealing beads, arranged at its extremities, at least one of these beads, called a specific bead (16), being in direct contact with the insulator (3) enclosing the heating element (4), characterized in that the specific bead (16) is axially traversed by an opening (18), into which is inserted a heat fuse (20) connected electrically in series with the heating element (4).

2. The electric heating device (1) according to claim 1, characterized in that the heating element (4) is in spiral form and mounted under tension in the tubular envelope (2).

3. The electric heating device (1) according to claim 2, characterized in that the opening (18) has a narrowing (21) at the level of the extremity connected with the interior of the tube, against which the fuse (20) is positioned.

4. The electric heating device (1) according to claim 3, characterized in that the heat fuse (20) has a housing (23) within which is housed a compression spring (28) exerting a pressure between, on the one hand, a heat block (24) situated at the outer extremity of the housing and in contact with an external connection pin (12) and on the other hand a central sliding disc (26) pushed while resting against an internal connection rod (10), and this against a restoring force exerted by an opening spring (32) coaxial with the connecting rod (10).

5. The electric heating device (1) according to claim 4, characterized in that the connecting rod (10) is surrounded, within the heat fuse (20), by an insulator (34).

6. The electric heating device (1) according to claim 5, characterized in that the heat block (24) is situated at the extremity of the fuse housing situated outside of the tubular envelope (2).

7. The electric heating device (1) according to claim 1, characterized in that the opening (18) has a narrowing (21) at the level of the extremity connected with the interior of the tube, against which the fuse (20) is positioned.

8. The electric heating device (1) according to claim 7, characterized in that the heat fuse (20) has a housing (23) within which is housed a compression spring (28) exerting a pressure between, on the one hand, a heat block (24) situated at the outer extremity of the housing and in contact with an external connection pin (12) and on the other hand a central sliding disc (26) pushed while resting against an internal connection rod (10), and this against a restoring force exerted by an opening spring (32) coaxial with the connecting rod (10).

9. The electric heating device (1) according to claim 2, characterized in that the heat fuse (20) has a housing (23) within which is housed a compression spring (28) exerting a pressure between, on the one hand, a heat block (24) situated at the outer extremity of the housing and in contact with an external connection pin (12) and on the other hand a central sliding disc (26) pushed while resting against an internal connection rod (10), and this against a restoring force exerted by an opening spring (32) coaxial with the connecting rod (10).

10. The electric heating device (1) according to claim 1, characterized in that the heat fuse (20) has a housing (23) within which is housed a compression spring (28) exerting a pressure between, on the one hand, a heat block (24) situated at the outer extremity of the housing and in contact with an external connection pin (12) and on the other hand a central sliding disc (26) pushed while resting against an internal connection rod (10), and this against a restoring force exerted by an opening spring (32) coaxial with the connecting rod (10).

11. The electric heating device (1) according to claim 4, characterized in that the heat block (24) is situated at the extremity of the fuse housing situated outside of the tubular envelope (2).

* * * * *